United States Patent [19]

Sakai et al.

[11] Patent Number: 4,988,055

[45] Date of Patent: Jan. 29, 1991

[54] COIL ASSEMBLY FOR POLYGONAL WIRE

[75] Inventors: Masahiko Sakai, Takahama; Mithuyuki Hayashi, Nishio; Toshihisa Taniguchi, Kariya, all of Japan

[73] Assignee: Nippondenso Co., Ltd., Kariya, Japan

[21] Appl. No.: 350,443

[22] Filed: May 11, 1989

[30] Foreign Application Priority Data

May 25, 1988 [JP] Japan ..... 63-128047

[51] Int. Cl.[5] ..... B65H 55/00; B65H 75/18

[52] U.S. Cl. ..... 242/159; 242/117

[58] Field of Search ..... 242/159, 117, 118.4, 242/118.7

[56] References Cited

U.S. PATENT DOCUMENTS

| | | | |
|---|---|---|---|
| 1,167,722 | 1/1916 | Scott . | |
| 2,732,150 | 1/1956 | LeBus, Sr. | 242/117 |
| 2,734,695 | 2/1956 | LeBus, Sr. | 242/117 |
| 2,892,598 | 6/1959 | Dudley | 242/117 |
| 3,110,096 | 11/1963 | Crowley et al. | 242/117 |
| 3,150,844 | 9/1964 | LeBus, Sr. | 242/117 |
| 3,289,972 | 12/1966 | Hafner | 242/118.7 |
| 3,391,879 | 7/1968 | LeBus, Sr. | 242/117 |
| 4,071,205 | 1/1978 | Wieschel | 242/117 |
| 4,130,256 | 12/1978 | Hosbein | 242/118.7 |
| 4,354,645 | 10/1982 | Glavas et al. | 242/117 |
| 4,796,830 | 1/1989 | Gelfman | 242/117 |

FOREIGN PATENT DOCUMENTS

| | | |
|---|---|---|
| 3433003 | 3/1986 | Fed. Rep. of Germany . |
| 61-88972 | 6/1986 | Japan . |
| 61-196743 | 8/1986 | Japan . |
| 428003 | 1/1967 | Switzerland . |

*Primary Examiner*—Stanley N. Gilreath

*Attorney, Agent, or Firm*—Cushman, Darby & Cushman

[57] ABSTRACT

A coil assembly including a coil of material having a square or hexagonal cross section wound on a bobbin. On the coil winding surface are a plurality of first mutually parallel grooves which have a V-notch cross section and are so arranged that the centers of adjacent grooves are separated from each other by a distance of about P which is the width of said grooves. The coil winding surface also has a plurality of second mutually parallel grooves which have a V-notch cross section and are so arranged that the centers of adjacent grooves are also separated from each other by the distance P. Each of the first grooves is off-set from the corresponding second groove in the axial direction by the distance of about P/2 or less. A pair of intermediate sections with oblique grooves having a predetermined length in the circumferential direction are provided between the respective ends of the first and second grooves.

6 Claims, 15 Drawing Sheets

COIL ASSEMBLY FOR POLYGONAL WIRE

BACKGROUND OF THE INVENTION

This invention relates to a winding device for winding a heavy-gauge wire made of a hard material, e.g., a metal wire, on a coiling drum or a bobbin in an orderly manner, and in particular, onto a winding device suitable for forming a coil to be used in the magnet switch of an engine starter, the rotor coil of an alternator, etc.

Japanese Utility Model Unexamined Publication (Jikkaisho) No. 61-88972 discloses an example of a winding device for winding a wire on a bobbin in an orderly manner. In the winding device disclosed, a plurality of wire guide grooves, which are parallel to each other, are provided on the outer peripheral surface of the winding drum, and the area in which the winding lines of a wire are shifted in the axial direction is formed as a flat, smooth surface devoid of any guide groove, thereby enabling the wire to be positively wound on the bobbin in an orderly manner at the first stage of winding. The problem with such a known device is that it does not allow for orderly coil winding when a coil is to be wound to the extent of providing a plurality of layers of coil.

BRIEF SUMMARY OF THE INVENTION

When winding a wire on a bobbin, a circumferential area is provided on the bobbin surface where the coil winding lines are to be shifted in the axial direction. Mainly due to the fact that such an area only exists at a single peripheral section of the bobbin, stable wire movement cannot be secured for the second coil layer winding and thereafter, and gaps between the wire lines in the second and subsequent layers therefore result. Accordingly, the wire lines in a given layer will inevitably enter any gaps in a lower layer, which leads to disorderly winding. If the coil itself is intended to be a part used in some special application, this disorderly winding will make it defective as a product. If the wire rolled in a number of layers is to be used as a material for general use as a wire, such disorderly winding will also be a problem since undesirable wire deformation may be involved due to the pressurizing force between the lines of the wire rolled in layers, or winding density may be reduced.

Accordingly, it is the principal object of this invention to provide a winding device which is capable of performing very stable multi-layer wire winding and of realizing high-density coil winding in an orderly fashion.

In order to attain this object, the following arrangement is provided in accordance with a first aspect of this invention: the coil winding surface of the body of the bobbin includes a plurality of first parallel grooves which are so arranged that the centers of adjacent grooves are separated from each other by a distance P which is the width of said grooves, and a plurality of second parallel grooves the ends of which do not meet with the ends of the first grooves and which are so arranged that the centers of adjacent grooves are also separated from each other by the distance P which is the width of said grooves, each of the first grooves being off-set from the corresponding second groove in the axial direction by the same distance P as that which separates the centers of adjacent grooves or less. It is recommended that this shift in the location of the lines of the wire at each round as it is helically wound on the bobbin is equivalent to about P/2. A pair of intermediate sections having a predetermined dimension in the circumferential direction of the body of the bobbin remain between the first and second groove groups. The first and second groove groups may be connected to each other through a pair of oblique-groove groups each consisting of a plurality of parallel oblique grooves formed in the above-mentioned pair of intermediate sections. Alternatively, the pair of intermediate sections may be simply formed as flat body surfaces.

According to a second aspect of this invention, the bobbin has on either end thereof a first and a second flange which are approximately perpendicular to the rotational axis thereof. Provided between the first flange and the first groove which is adjacent thereto (by a "first groove" is meant a groove belonging to the first groove group) is a first projection having an axial width of ca. P/2. Provided between the second flange and the second groove which is adjacent thereto (by a "second groove" is similarly meant a groove belonging to the second groove group) is a second projection having an axial width of ca. P/2. These two projections serve to guide a wire along the flanges when it proceeds from the first to the second winding stage, thereby facilitating orderly winding of the wire.

According to a third aspect of this invention, a coil assembly is provided which consists of a bobbin and a coil wound thereon, the bobbin itself being used as a part which is designed to be integrally used with the coil.

Other objects and features of this invention will become apparent from the description below which is given with reference to the accompanying drawings.

BRIEF DESCRIPTION OF THE DRAWINGS

FIGS. 2 through 9B are similar drawings wherein:

FIG. 2 is a sectional view taken along the line II—II of FIG. 1;

FIG. 4 is a schematic diagram illustrating the behavior locus of the wire shown in FIG. 3;

FIG. 6 is a front elevational view showing an essential part of the inter-stage shift section when a second winding is performed on the second stage of the bobbin shown in FIG. 1;

FIG. 8 is a schematic diagram showing the locus of the wire shown in FIG. 7A to 7D;

FIGS. 9A and 9B are a front elevational view and a sectional view, respectively, illustrating a case where an abnormal winding condition has been generated in the inter-wire shift stage;

DETAILED DESCRIPTION OF THE INVENTION

The invention of the present invention conducted the following analysis in order to find out why conventional winding devices do not permit multi-layer wire winding to be performed in a stable manner.

Figure 1:
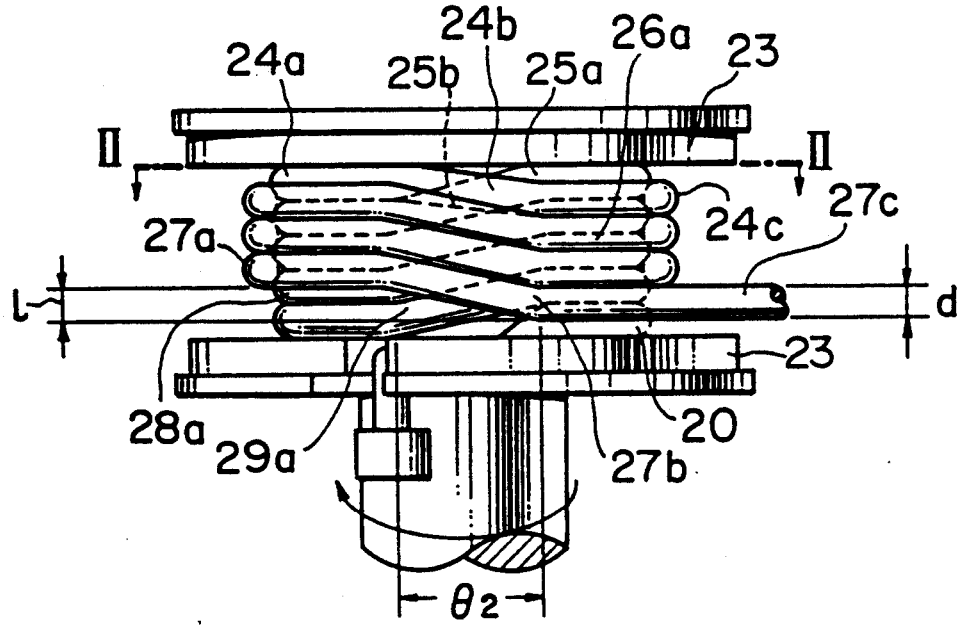
FIG. 1 is a front elevational view intended to be used for illustrating the inconvenience that is likely to be encountered in conventional winding devices, showing how second-stage coil winding is performed on a bobbin which serves as the wire coiling drum.

FIG. 1 shows a coil winding operation performed on the cylindrical body of a bobbin, which has on either ends thereof a pair of flanges 23, constituting a wire winding drum during the shift from the first to the second coil winding stage. Formed on the bobbin are a plurality of grooves which are parallel to each other, part of the peripheral bobbin surface being formed as a flat and smooth area. This flat and smooth area serves as the wire shift area $\theta_2$ (FIG. 2) to assist in the winding of a coil onto the bobbin. That is, the wire shift area is concentrated in a certain area circumferential direction, and the wire being wound is shifted from one groove to another by a displacement amount which corresponds to the groove pitch, i.e., the diameter of the wire.

Figure 3A:
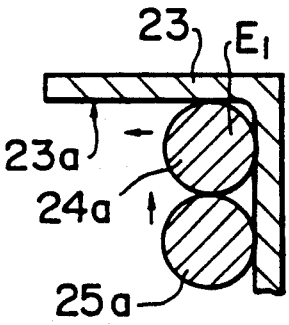
FIGS. 3A to 3G are sectional views illustrating the behavior of the wire portion as it is wound on the bobbin, shifting from the first to the second winding stage through the shift area $\theta_2$ in FIG. 2.
Figure 3B:
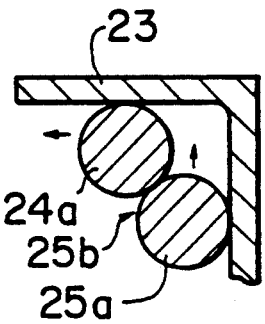
Figure 3C:
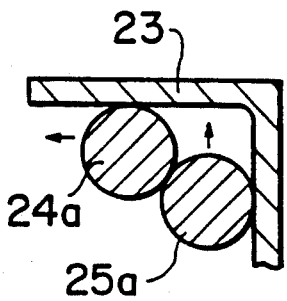
Figure 3D:
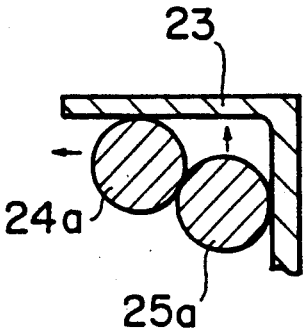
Figure 3E:
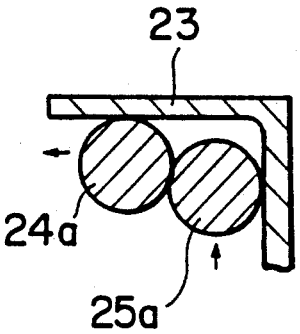
Figure 3F:
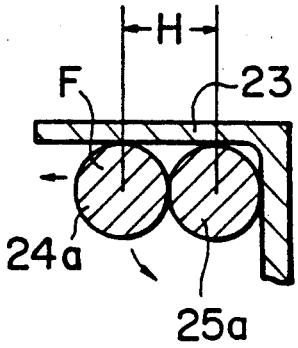
Figure 3G:
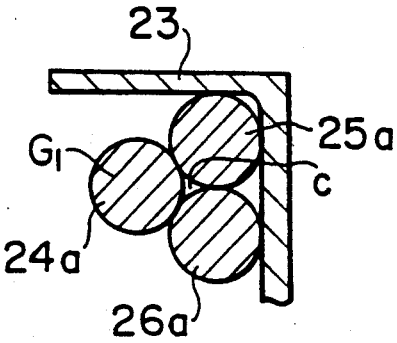
Figure 4:
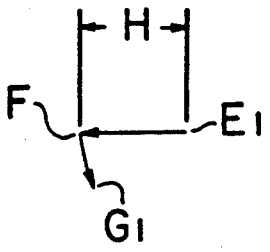

First, the behavior of the wire at the position where it is wound on the bobbin in the inter-stage shift section between the first and second stages in the coil shift area $\theta_2$ will be described with reference to FIGS. 3A to 3G. The wire 24*a* shown in FIG. 3A, which has already been wound round the bobbin end surface 23*a*, is moved radially outwards, while being kept in close contact with the curved surface 25*b* of the adjacent lower stage line 25*a* and the bobbin end surface 23*a*, as shown in FIGS. 3C to 3F. Immediately after it reaches the top of the lower stage line 25*a*, it moves to a valley "c" formed between the lower stage lines 25*a* and 26*a* as it makes a circular movement about the outer periphery of the lower stage line 25*a* under the tension exerted on the wire (FIG. 3G). FIG. 4 shows the movement of the wire winding point until the above-mentioned wire 24*a* reaches the depression c.

Figure 2:
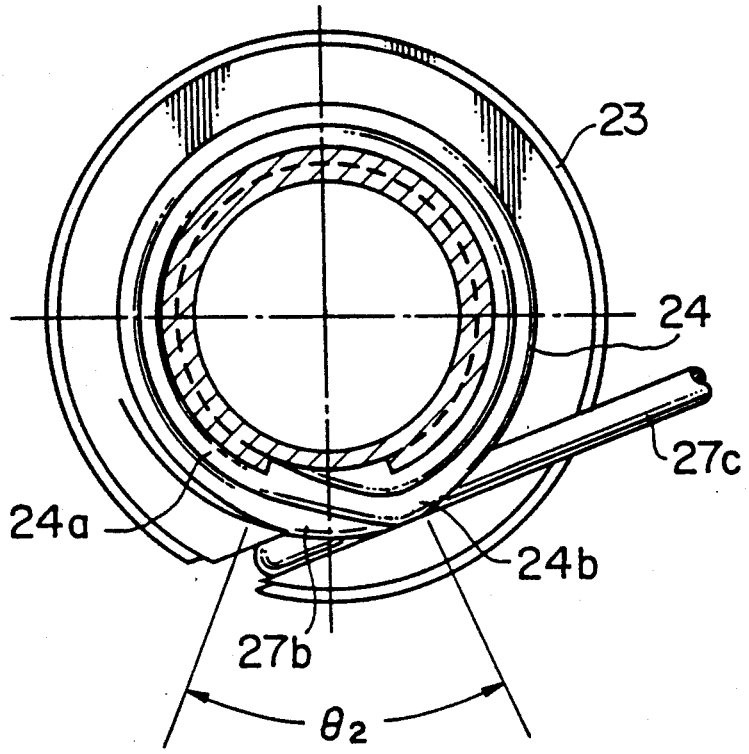
Figure 5A:
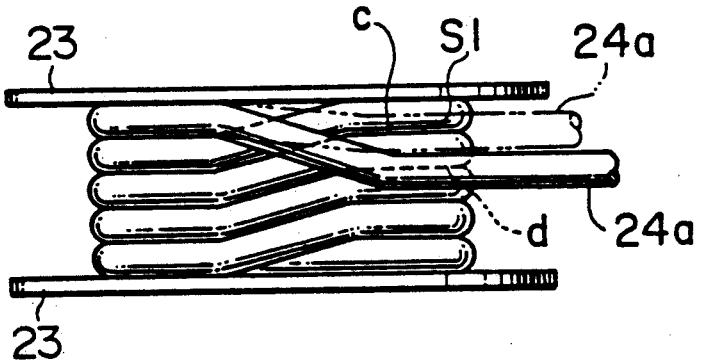
FIGS. 5A and 5B are a front elevational view and a sectional view, respectively, illustrating a case where abnormal winding occurred in the inter-stage shift section.
Figure 5B:
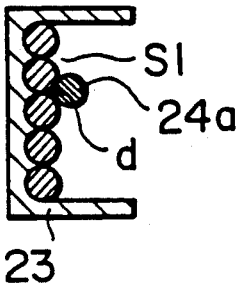

Accordingly, in conventional wire winding devices, the wire inter-stage section situated in the shift area $\theta_2$ shown in FIG. 2 is concentrated in a certain area in the circumferential direction. Since the wire displacement amount in that area is equal to the wire diameter, the wire movement in the inter-stage shift area must be such that two movements, i.e., the outward radial motion with respect to the bobbin rotational axis from the start position $E_1$ to the position F in FIG. 3F and the circular movement from the position F to the terminal $G_1$ in the valley "c", are continuously performed. As a result, at the position F shown in FIG. 3F, the force which pushes up the wire 24*a* radially outwards overcomes the tension component pulling the wire 24*a* into the valley "c" and the frictional force acting between the wire 24*a* and the lower stage line 25*a*, thereby causing the wire 24*a* to move to the next valley "d", passing the valley "c", as indicated by the solid line of FIG. 5A and 5B. This causes a gap to be generated in the first winding section $S_1$ of the second winding stage. This can be the cause of disorderly winding because the next stage winding section, i.e. that of the third winding stage will get into the gap.

Figure 6:
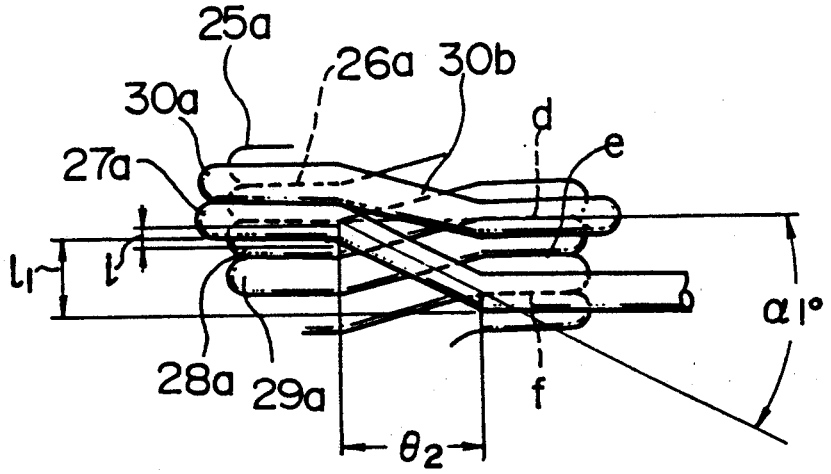
Figure 7A:
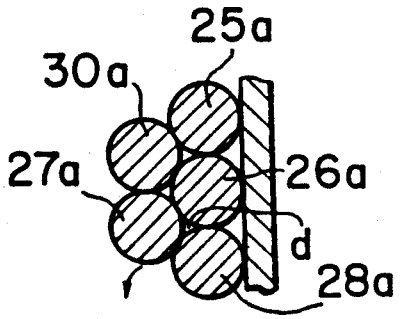
FIGS. 7A to 7D are sectional views illustrating the behavior of the wire from the start to the end of the inter-stage shift section of FIG. 6.
Figure 7C:
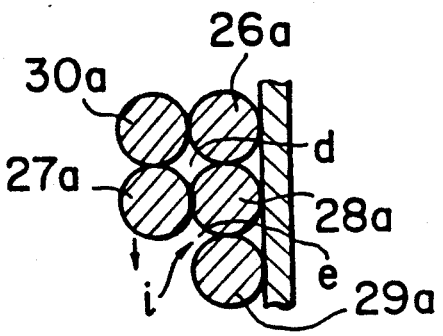
Figure 7B:
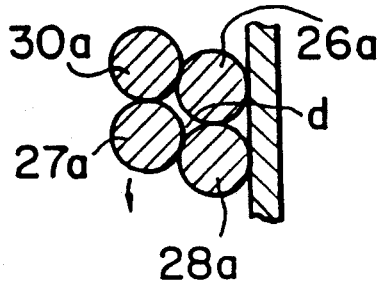
Figure 7D:
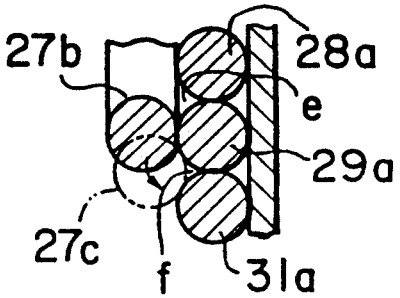

Next, the inter-wire shift in the second to the last winding in the same winding stage will be described with respect to the second winding stage and thereafter. FIG. 6 locally illustrates the lower stage lines 25a, 26a, 28a, 29a and the second stage lines 27a, 30a, of the winding section. FIGS. 7A to 7D shows stepwise the behavior of the wire in the wire shift area $\theta_2$ shown in FIG. 6. After completing the winding on the valley "d" formed between the lower stage lines 26a and 28a shown in FIG. 7A, the wire 27a which is at the second stage winding comes in contact with the shift section of the lower stage line 28a shown in FIG. 7B. It is then made to perform a circular movement along the curved surface of the shift section of the lower stage line 28a and along the shift section 30b of the winding line 30a, reaching the top of the lower stage line 28a shown in FIG. 7C. Properly, the wire 27a should move to the valley "e" between the shift areas of the lower stage lines 28a and 29a. However, as is apparent from FIG. 6, the lower stage lines 28a and 29b are in close contact with each other. In addition, the wire 27a is twisted in the reverse direction to the lower stage lines, i.e., it is twisted to the left, so that it has to go over the lower stage lines in a X-like manner. As a result, it cannot move to the valley "e", and goes over the top of another lower stage line, i.e., the line 29a, moving to the valley "f" between the lower stage lines 29a and 31a shown in FIG. 7D. That is, the inter-wire shift is such as is indicated by the shift from the position $E_2$ to $G_2$ of FIG. 8. The movement that is imparted to the wire 27a is such that three movements, i.e., the first circular movement (the wire 27a moves as shown in FIGS. 7A and 7B, the linear movement (the wire 27a moves over the lower stage line 29b as shown in FIG. 7C) and the second circular movement (the wire 27c moves to the valley "f" as shown in FIG. 7D), are effected continuously.

Figure 8:
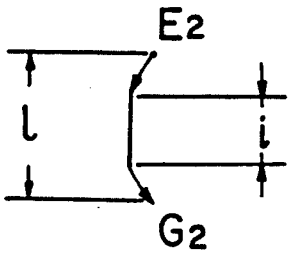
Figure 9A:
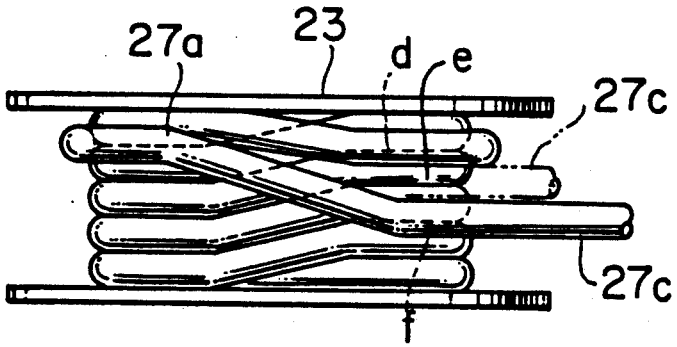
Figure 9B:
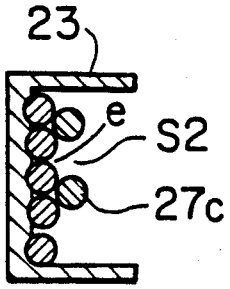

As described above, if the shift sections are concentrated on a certain part on the peripheral surface as shown in FIG. 2, a given line has to move over a lower stage line twice when it moves over two lower stage lines approximately at the same time. As a result, as shown in FIG. 8, when in the moving-over middle section "i", the wire 27a slips sideways over the lower stage lines 28a and 29a and moves to the next valley "f", as indicated by the solid line of FIG. 9A, since the redundant force of the shift pressure angle $\alpha_1°$ (FIG. 6) generated by the shift area amount l (FIG. 8) and the position shift amount $l_1$ (FIG. 6) and the tensional force imparted to the wire overcomes the force pulling the wire 27a into the valley "f" between the lower stage lines 29a and 31a. Because of these factors, a gap is generated in the second winding section $S_2$ of the second winding stage, as shown in FIG. 9A and 9B. This can be the cause of disorderly winding, as in the inter-stage shift section, because the next stage winding will get into the gap.

In accordance with this invention, which is based on the result of the above analysis, an inter-stage shift and an inter-wire shift can be realized in which the wire behavior during winding is fairly moderate and in which the wire will not easily ship, thereby making it possible to perform multi-stage winding in a very stable manner, and consequently to conduct orderly winding in a desired manner.

Furthermore, this invention also makes it possible to improve the rotational balance of a winding drum while a coil is being wound thereon, thereby substantially reducing losses such as wastage of wire due to defective products and excessive labour requirements due to the need to balance modify balance. These advantages will become more apparent from the detailed description of preferred embodiments of the invention given below.

DESCRIPTION OF THE PREFERRED EMBODIMENTS

Figure 10:
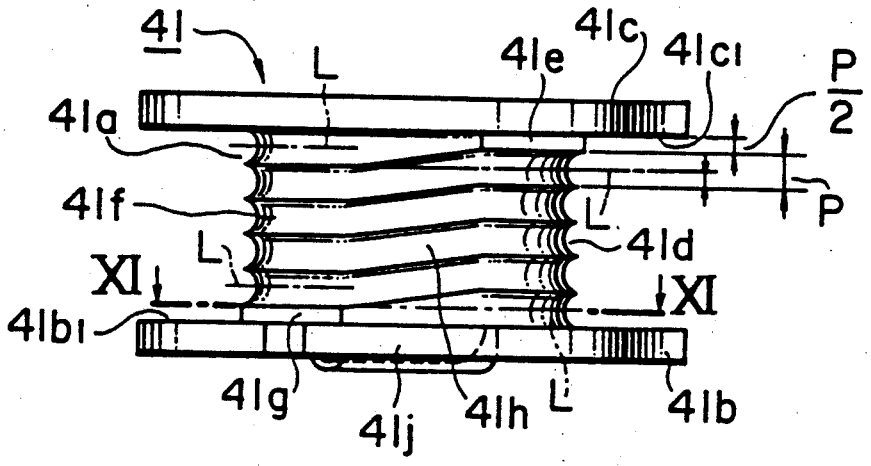
FIG. 10 is a front elevational view showing a winding bobbin constituting an embodiment of this invention.

FIG. 10 shows a bobbin 41 which serves as a coiling drum and comprises a cylindrical body 41a on which a coil is wound and a first and a second flange 41b and 41c formed perpendicular to the drum axis. The bobbin 41 is mounted in the condition in which a wire 42 (see FIG. 14) is wound spirally on the body 41a, as a coil assembly. The bobbin 41 is normally formed from plastic, but it can also be formed from some other hard material. Formed on part of the peripheral surface of the body 41a, from the inner side wall surface $41b_1$ of the first flange 41b, are a first group of five mutually parallel grooves 41d which are parallel to the first and second flanges 41b and 41c. It will be understood that the number of grooves 41d need not necessarily be limited to five; the number can be changed as needed. Further, formed between that first groove 41d which is nearest to the second flange 41c and the inner side wall surface $41c_1$ is a first projection 41e having a width corresponding to half the width P of the first grooves 41d.

Also formed on the peripheral surface of the body 41a, from the inner side wall surface $41c_1$ of the second flange 41c to the first flange 41b side, are a second group of five mutually parallel grooves 41f which are parallel to the first and second flanges 41b and 41c. What is stated above with respect to the number of grooves 41d correspondingly applies to the number of grooves 41f. Formed between that second groove 41f which is nearest to the first flange 41b and the inner side wall surface $41b_1$ of the first flange 41b is a second projection 41g having a width corresponding to half the width P of the first and second grooves 41d and 41f.

Figure 11:
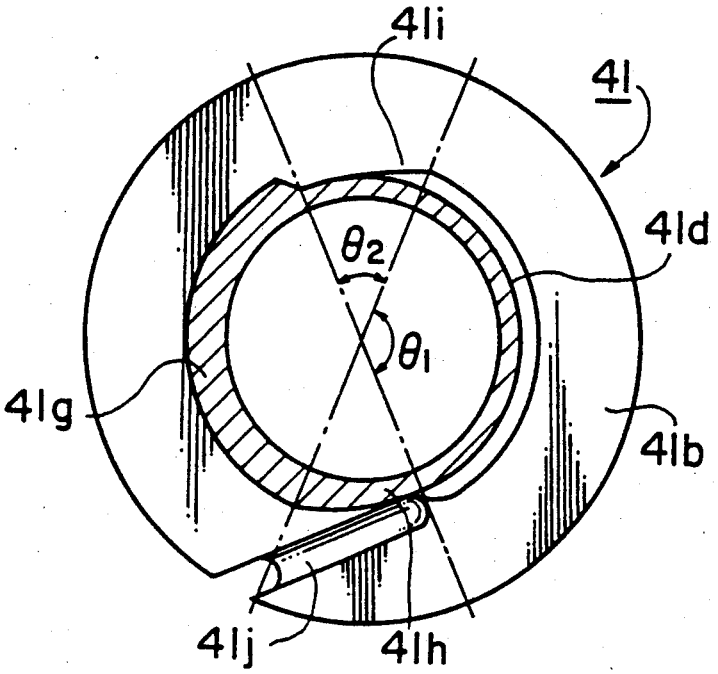
FIG. 11 is a sectional view of the bobbin taken along the line XI—XI of FIG. 10.

Further, as shown in FIG. 11, the first and second grooves 41d and 41f are formed symmetrically, each extending over the peripheral range corresponding to a first angle $\theta_1$.

According to the result of an experiment conducted by the inventors, the distance from the respective inner side wall surfaces of the first and second flanges 41b and 41c to the respective groove width centers of the grooves nearest to the flanges 41b and 41c (see the linear line L in FIGS. 10 and 12) is preferably set at P (permissible error: +0.2 P) where the projections 41g and 41e are provided, and at p/2 (permissible error: +0.2 P) where no projections 41g and 41e are provided. The reason for this is that, if the distance between the respective centers of the grooves nearest to the flanges and the flanges 41b, 41c, and the distance between the respective centers of the grooves nearest to the projections and the respective side surfaces of the projections 41g, 41e (whose width in the axial direction is P/2) were less than P/2, the wire portion wound in the first groove would be pushed up to become higher than the wire portions wound in the other grooves. This condition can be the cause of disorderly winding. As for the relationship between adjacent grooves excluding the grooves nearest to the flanges or the projections, the distance from the border line between two adjacent grooves to the respective groove centers is preferably set at P/2 (permissible error: ±0.2 P), according to the result of an experiment conducted by the inventors. The minimum value can be 0.3 P because of the mutual relationship between the wire lines wound around the body 41*a* of the bobbin 41 a certain number of times. Winding is possible even if a relatively narrow groove partly exists. However, if the number of winding on the body 41*a* is, for example, five, the length of the winding surface in the axial direction of the body 41*a* must be at least 5 P.

Figure 12:
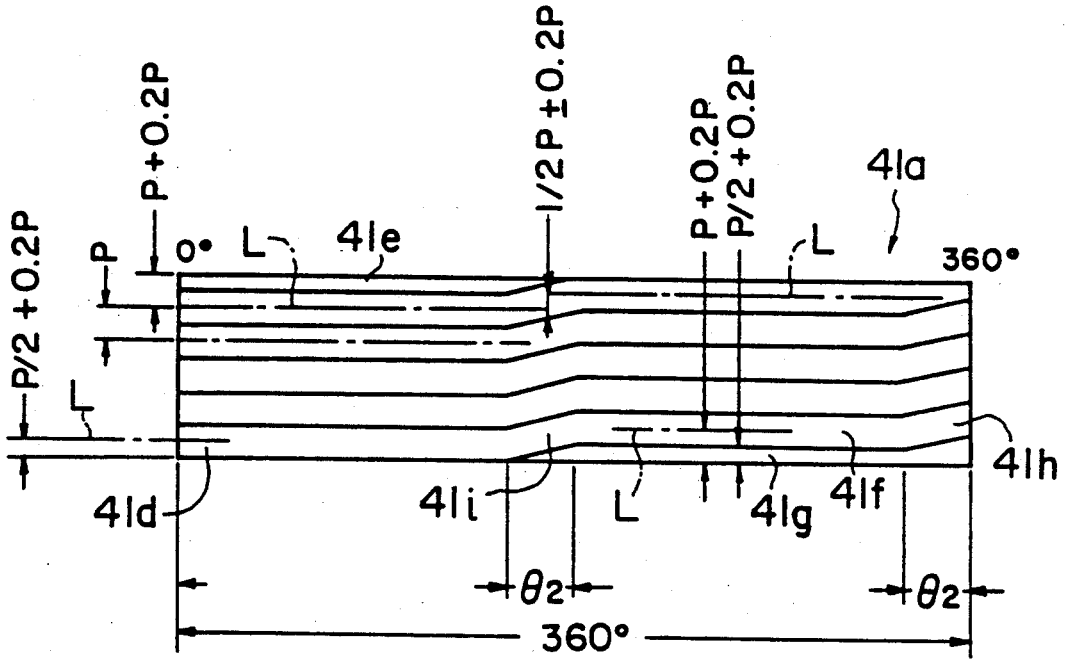
FIG. 12 is a development of the bobbin shown in FIG. 10.

As shown in FIGS. 10 and 12, the first and second grooves 41*d* and 41*f* are off-set from each other in the axial direction by a dimension equivalent to about half the groove width P (that is, P/2). The permissible error for this spacing is ±0.2 P. This value has been verified by experiment.

Further, formed between the first and second groove groups 41*d* and 41*f*, i.e., in a pair of intermediate sections, are first and second oblique grooves 41*h* and 41*i* connecting these sets of grooves 41*d* and 41*f* to each other and traversing the widthwise shift of P/2. As shown in FIG. 11, these oblique grooves 41*h* and 41*i* are symmetrically formed, each extending over the peripheral range corresponding to a second angle $\theta_2$ which corresponds to the shift areas.

Figure 13:
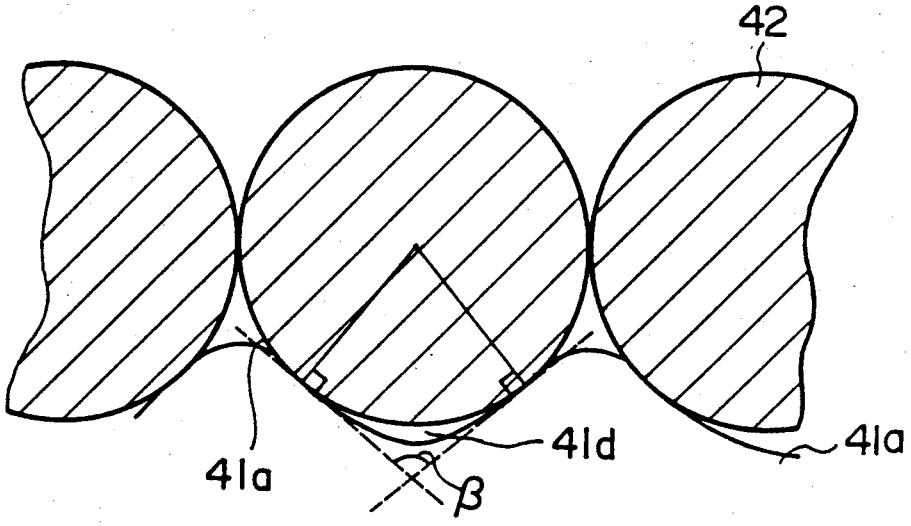
FIG. 13 is a sectional view showing the sectional configuration of the groove formed on the wire winding surface of the bobbin as well as the relationship between the groove and the wire.

The configuration of the first and second grooves 41*d* and 41*f* is preferably such that the angle of intersection (FIG. 13) which, in an Phantom plane, traverses the bobbin axis and which is made by the two tangents respectively passing through the points at which the winding wire is in contact with the opposed inner side wall surfaces of a groove, is in the range 90° to 120°, thereby allowing the wire to be positively secured in the grooves.

Further, the first flange 41*b* (FIG. 11) includes a guide groove 41*j* for leading a wire 42 onto the winding surface of the body 41*a*.

Figure 14:
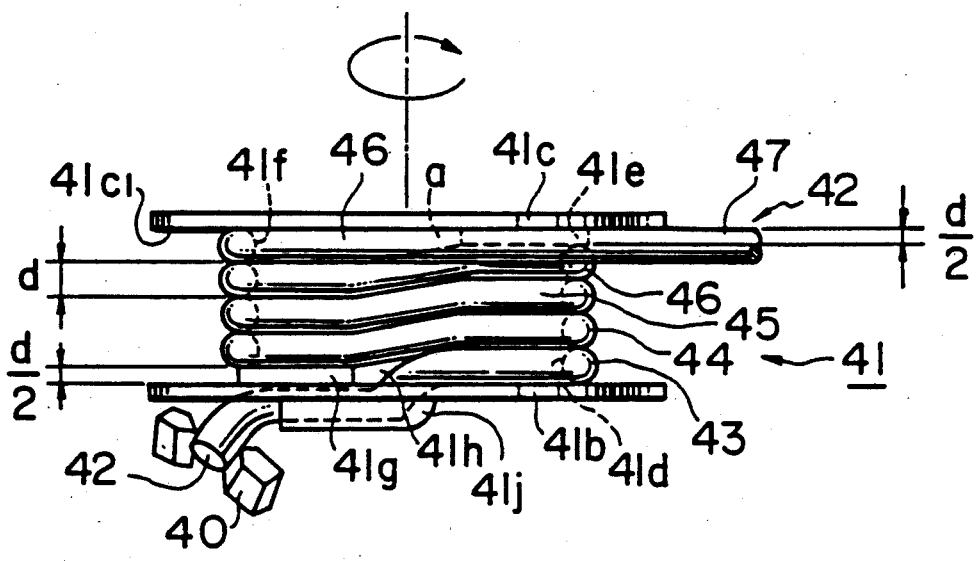
FIG. 14 is a front elevational view illustrating the condition in which the winding on the bobbin of FIG. 10 is shifted from the first to the second winding stage.

Next, the process of winding a round wire 42 onto the bobbin 41 will be described with reference to FIGS. 14 and 16. The diameter "d" of this wire 42 is substantially the same as the width P of the first and second parallel grooves 41*d* and 41*f*. Clamped in a clamping jig 40, the wire 42 passes through the winding-start guide groove 41*j* and begins to be wound in the first parallel groove 41*d* on the side of the first flange 41*b* of the bobbin 41. The bobbin 41 is linked with a driving motor (not shown), by which it is driven to rotate. As indicated by the arrow in FIG. 14, the bobbin 41 rotates clockwise. The wire 42 is supplied to the bobbin 41 by a wire supply mechanism (not shown) as it traverses toward the bobbin. Thus supplying the wire by making it traverse allows the wire behavior to become more moderate, thereby speeding up the rotation of the bobbin and facilitating orderly wire winding. After being wound in the first parallel groove 41*d*, the wire 42 begins to rise as if being lead, guided by the second oblique groove 41*i* (FIG. 16) connected to the next parallel groove 41*f*, to be wound in the second parallel groove 41*f*. The amount which the wire rises at this stage is approximately half the wire diameter (P/2). After being wound in the second parallel groove 41*f*, it moves through the first oblique groove 41*h* (FIG. 14) to the next first parallel groove 41*d*. The amount which the wire rises at this stage is also approximately half the wire diameter.

Accordingly, the wire 42 passes two wire shift areas ($\theta_2$) of FIG. 12 while making one round of the body 41*a* of the bobbin 41, the shift amount at each shift being approximately half the wire diameter. The first winding wire line 43 of the first winding stage is wound in this way. This is repeated a number of times until the last winding wire line 46 of the first winding stage is reached, which completes the first winding stage on the bobbin 41.

Next, the inter-stage shift between the first and second coil winding stages will be described with reference to FIG. 14. The bobbin 41 of this invention includes the first and second projections 41*e* and 41*g* having a width of approximately d/2 (=P/2). Since a gap having a width of approximately half the wire diameter is inevitably formed between the fourth winding line 46 in the first winding stage and the inner side wall surface 41*c*$_1$ of the second flange 41*c*, as shown in FIG. 14, the wire behavior at the position "a" of the bobbin 41 between the first and second winding stages will resemble what is illustrated in FIGS. 18 to 20.

Figure 15:
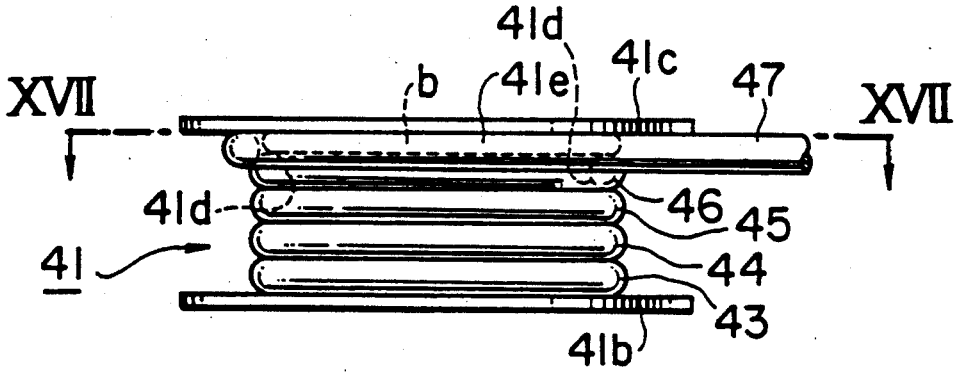
FIG. 15 is a front elevational view illustrating the condition in which the wire shown in FIG. 14 has been rotated ca. 90° after being shifted to the second winding stage.
Figure 17:
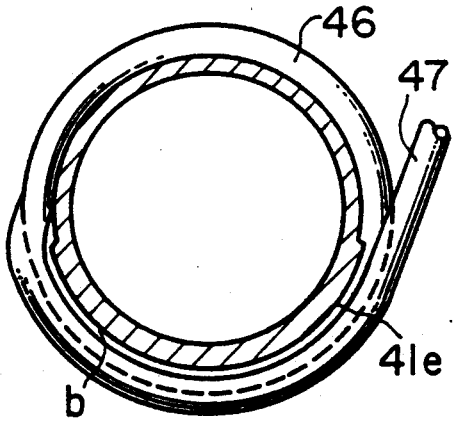
FIG. 17 is a sectional view taken along the line XVII—XVII of FIG. 15.
Figure 19A:
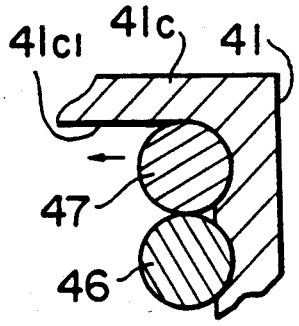
FIGS. 19A, 19B and 19C are sectional views illustrating the behavior of the wire from the start to the end of the inter-stage shift section on the bobbin shown in FIG. 10.
Figure 19B:
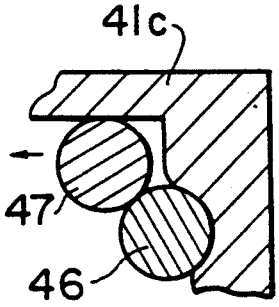
Figure 19C:
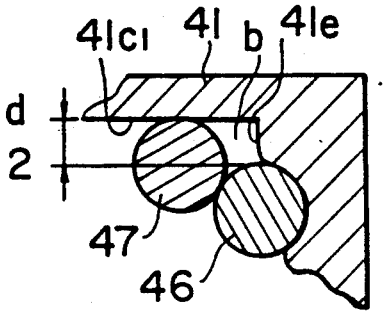

FIGS. 19A to 19C shows the state in which the last winding line 46 of the first winding stage is about to be shifted to the second winding stage. Because of the last winding line 46 rising a certain amount due to the first oblique groove 41*h*, the gap between the last winding line 46 and the inner side wall surface 41*c*$_1$ of the second flange 41*c* is relatively narrow, as indicated by "a" in FIG. 14. As shown in FIG. 20, a force directed radially outwards is gradually imparted to the second-stage starting winding line 47. Afterwards, as shown in FIGS. 15, 17 and 19C, the second-stage starting winding line 47 is shifted to the second stage, and is retained in the depression "b" between the last winding line 46 of the first winding stage and the inner side wall surface 41*c*$_1$ of the second flange 41*c*.

Figure 20:
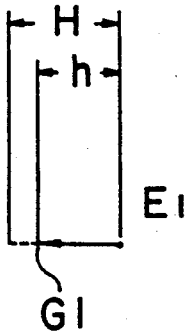
FIG. 20 is a schematic diagram illustrating the locus of the wire in the inter-stage shift section of the bobbin of this invention.

Thus, while the inter-stage shift is conventionally effected through two movements, i.e., through an outward radial movement with respect to the bobbin rotational axis and a circular movement, as shown in FIG. 4, this invention makes it possible to effect the inter-shift change solely through the simple outward radial movement from the starting position $E_1$ to the terminal $G_1$, as shown in FIG. 20. In addition, the movement amount "h" of the second-stage starting winding line 47 in the radial direction is smaller than the conventional movement amount "H", thereby completely eliminating any tendency for the line to slip into the adjacent valley.

Figure 16:
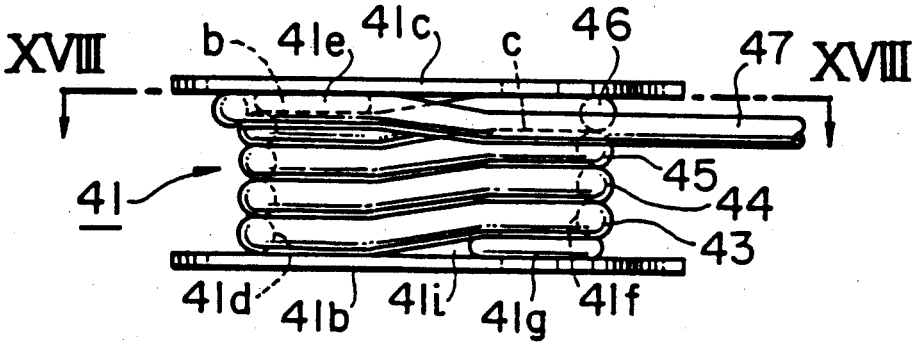
FIG. 16 is a front elevational view illustrating the inter-wire shift section when the first winding of the second stage is effected on the bobbin shown in FIG. 15.
Figure 18:
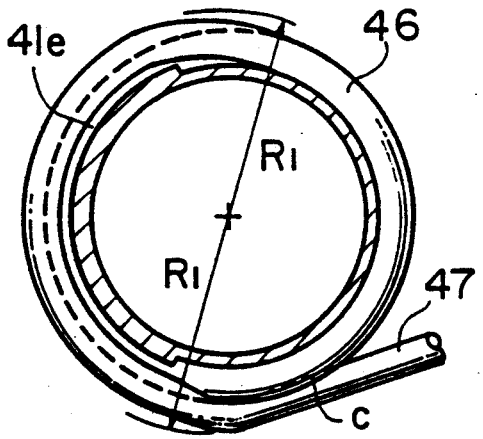
FIG. 18 is a sectional view taken along the line XVIII—XVIII of FIG. 16.

As shown in FIGS. 16 and 18, the second-stage starting winding line 47 is positioned in the valley "c" between the third winding line 45 and the last winding line 46 of the first stage, and is retained therein when it passes the shift area $\theta_2$ (FIG. 12).

Next, the wire movement, i.e., the inter-wire shift in the second to last winding of the same winding stage, will be described with respect to the second winding stage and thereafter. In accordance with this invention, the shift areas $\theta_2$ (FIG. 12) comprise two sections on the peripheral bobbin surface, the parallel-groove linking amount being approximately half the wire diameter. Thanks to this arrangement, the second winding line 48 of the second winding stage goes over the top "e" of the first-stage line 45 only once when it moves from the valley "c" between the first-stage lines 45 and 46 to the valley "d" between the first-stage lines 44 and 45. That is, the winding line 48 goes over the top of a first-stage winding line twice, once for each half rotation, during one-round winding thereof.

Figure 23:
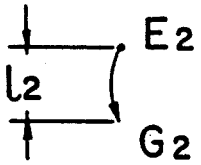
FIG. 23 is a schematic diagram illustrating the behavior locus of the wire of FIG. 22A to 22D.
Figure 22A:
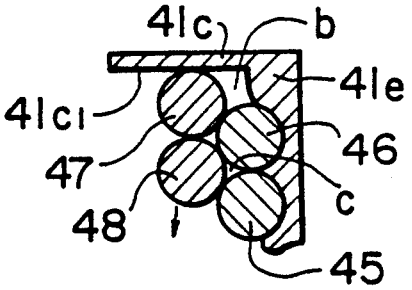
FIGS. 22A, 22B, 22C and 22D are sectional views illustrating the behavior of the wire from the start to the end of the shift in the inter-wire shift section $\theta_2$ illustrated in FIG. 21.
Figure 22B:
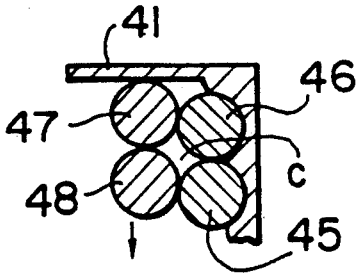
Figure 22C:
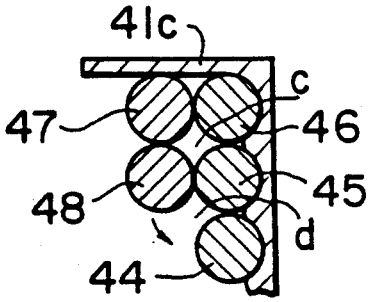
Figure 22D:
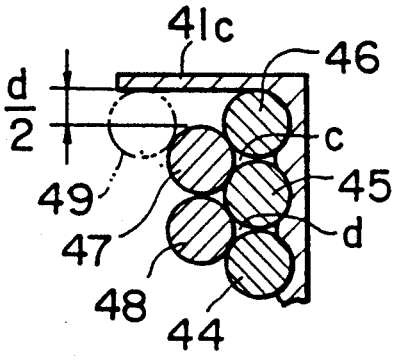

FIGS. 22A to 22D illustrate the way it goes over the top of a first-stage winding line once. The wire position shift of the second-winding line 48 of the second stage from the depression "c" to the valley "d" can be effected solely through a simple circular movement, as shown in FIG. 23, the shift amount $l_2$ being only half the wire diameter "d" and the shift section pressure angle $\alpha_2$ reduced by half (see FIGS. 21 and 6). In prior art methods, the wire shift is effected at one position on the peripheral surface, so that two lines go over a lower stage line at one time, as shown in FIGS. 7A to 7D. As shown in FIG. 8, the wire shift is conventionally effected through three movements (circular+linear+circular), which involves the problem of wire slip in the linear movement section, whereas, in accordance with this invention, only one wire line goes over the lower stage line in the inter-wire shift section, i.e., the going-over is effected twice during one-round winding, with the result that the wire shift is simplified by enabling it to be effected solely through a circular movement, both the shift amount $l_2$ and the shift pressure angle $\alpha_2$ being reduced by half. Thanks to this arrangement, the slip effect on the wire is reduced by half. Furthermore, the acceleration depending on the shift pressure angle is also reduced, which leads to reduction in the speed at which a given winding line goes over the top of a lower-stage line, thereby enabling the inter-line shift to be effected in a very stable manner.

Figure 24:
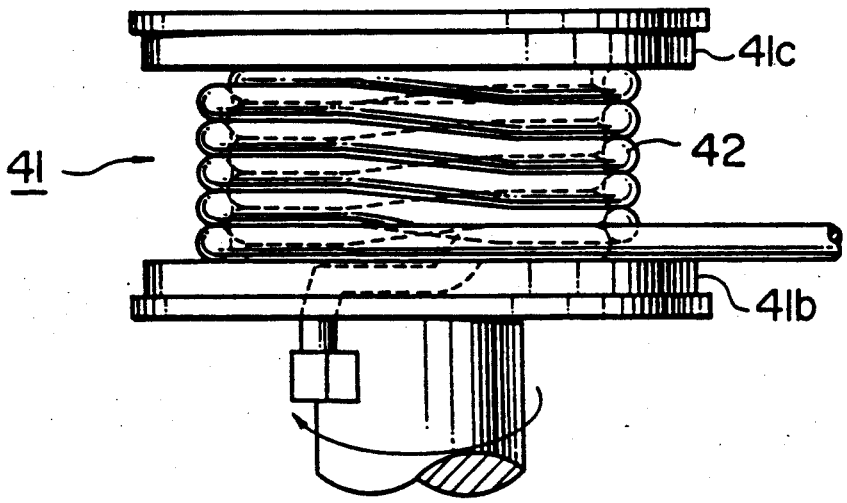
FIG. 24 is a front elevational view illustrating the bobbin of this invention when the winding is about to be shifted to the third stage after completing the last winding of the second stage.
Figure 25:
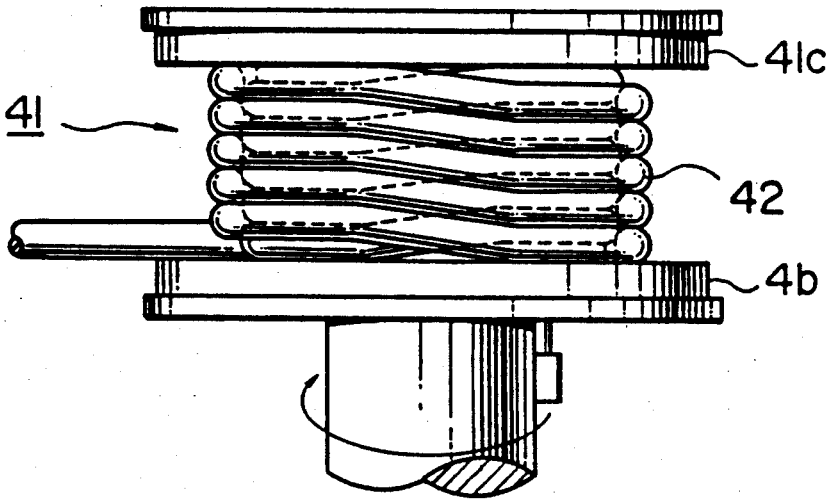
FIG. 25 is a front elevational view showing in 180° symmetry a plan view of the bobbin of FIG. 24.

Accordingly, as shown in FIGS. 24 and 25, the first-stage winding of the wire 42 as well as the wire shift thereof can also be effected in a stable manner, thereby making it possible to realize a positive orderly winding even in the case of multi-stage winding.

Second, as shown in FIGS. 11 and 12, the wire shift area $\theta_2$ is divided into two sections which are arranged in opposed positions, with the result that the radii R1 of the shift areas $\theta_2$ after winding are approximately equal to each other, as shown in FIG. 18, thereby balancing the rotation of the winding product, so that no balance modification is needed after winding.

The bobbin 41 serving as the coiling drum can also be regarded as a coil forming device, and the coil obtained through the above-described embodiment can be used, for example, as the magnet switch coil of an engine starter.

Figure 26:
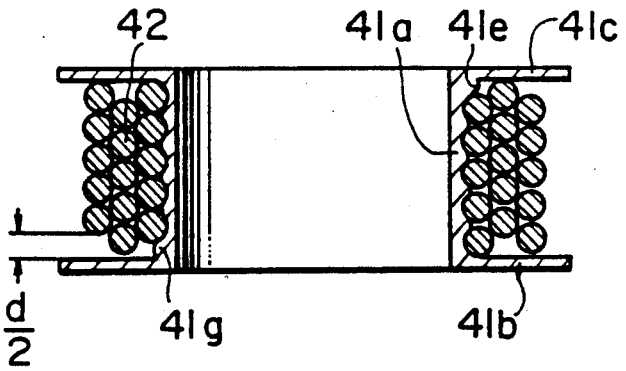
FIG. 26 is a sectional view of a winding device using the bobbin shown in FIG. 10.
Figure 27:
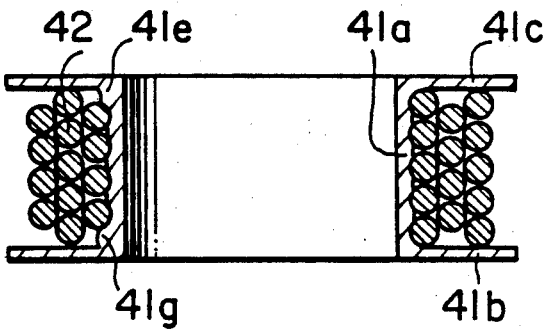
FIG. 27 is a sectional view of a winding device using a bobbin in accordance with another embodiment of this invention.

While the first and second projections 41*e* and 41*g* are formed at positions opposed by 180° in the example shown in FIG. 26, they may also be formed on the same side, as shown in FIG. 27.

Figure 28A:
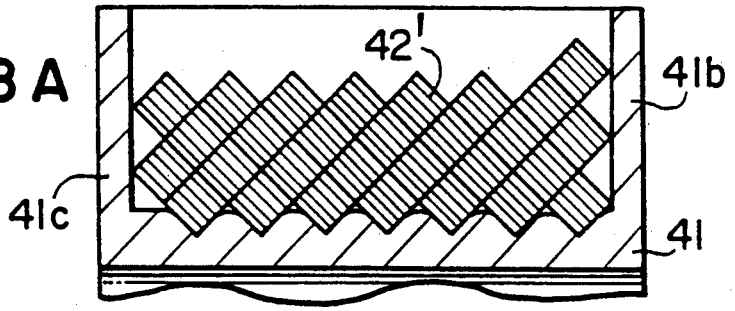
FIG. 28A is a sectional view of a winding device on which a wire with a square cross-sectional configuration is wound.
Figure 28B:
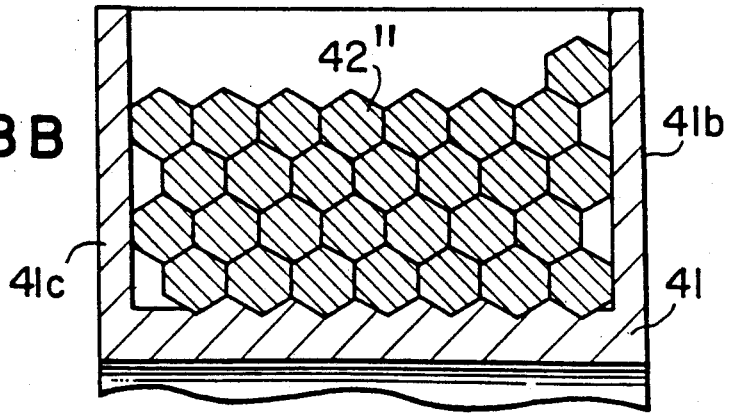
FIG. 28B is a sectional view of a winding device on which a wire with a hexagonal cross-sectional configuration is wound.

Further, while in the above-described embodiment a circular-sectioned wire is adopted for the wire 42, it is also possible to use a square-sectioned wire 42' or a hexagonal-sectioned wire 42", as shown in FIGS. 28A and 28B, thereby improving the wire space factor on the bobbin.

Figure 29:
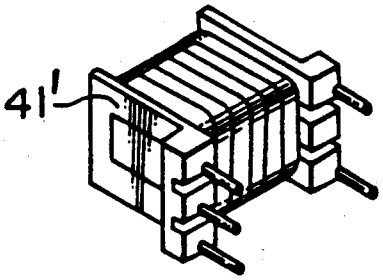
FIG. 29 is a perspective view of a winding device having a square bobbin on which a wire is wound.

Further, this invention can also be applied to a square bobbin 41', as shown in FIG. 29.

In the above-described embodiment of this invention, first and second oblique grooves 41*h* and 41*i* are respectively formed between the first and second parallel grooves 41*d* and 41*f*. Alternatively, the sections between the first and second parallel grooves 41*d* and 41*f* may be formed as circular smooth surfaces.

Further, while in the above example the first and second parallel grooves 41*d* and 41*f* are parallel to the first and second flanges 41*b* and 41*c*, no particular problem will arise if they are not parallel but a little inclined with respect to the flanges.

Figure 21:
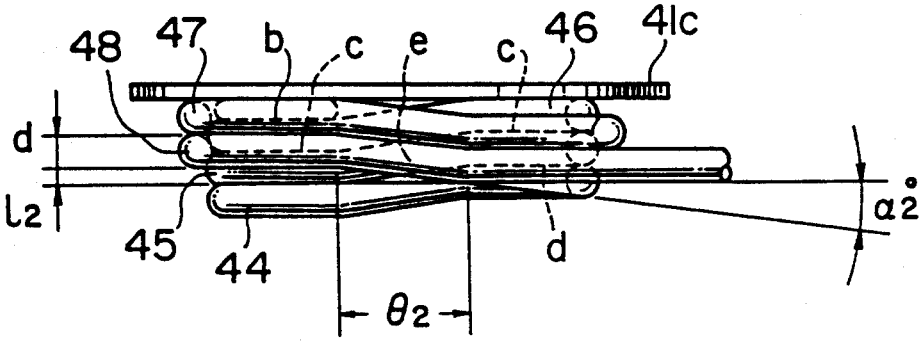
FIG. 21 is a front elevational view illustrating an essential part of the inter-wire shift section when the winding is shifted from the first winding of the second stage shown in FIG. 16 to the second winding of the same stage.

The length in the circumferential direction of the first and second oblique grooves 41*h* and 41*i* (the second angle $\theta_2$) is preferably set such that the angle $\alpha_2$ shown in FIG. 21 becomes 1° or so when the diameter of the wire 42 is around 1 mm.

Further, while in the above-described embodiment the first and second parallel grooves 41*d* and 41*f* are off-set from each other in the axial direction by half the groove width P, no particular problem will arise if the spacing is somewhat different from P/2 due to a manufacturing error.

Figure 30:
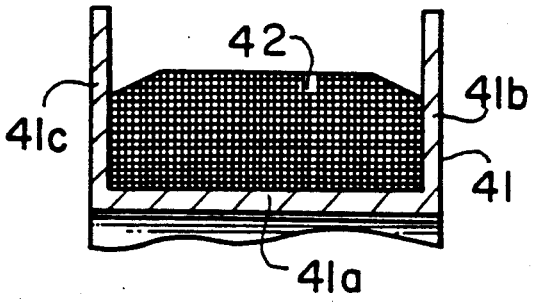
FIG. 30 is a sectional view illustrating another embodiment of the winding device of this invention.

If the above spacing distance exceeds P/2 to an excessive degree, multi-layer winding of the wire 42 on the bobbin 41 will result in inclination of the coil sections near the first and second flanges 41*b* and 41*c*, as shown in FIG. 30. The more the number of layers, the more inclined the sections, the inter-wire depression gaps becoming smaller and the orderly winding of the wire 42 more susceptible to collapse. In view of this, the spacing amount is to be appropriately set when winding the wire in a predetermined number of layers, in accordance with the particular conditions (wire diameter, number of layers, etc.) so that orderly winding can be effected.

Next, an embodiment related to the manufacture of plastic bobbins will be described (see FIGS. 31 to 36). The bobbin 51 shown is mounted in the condition in which a wire 55 is wound in a coil-like manner on the cylindrical body 52 thereof (e.g., in the same condition as that shown in FIGS. 26 and 27), i.e., as a coil assembly. The bobbin 51 is formed from a glass fiber reinforced plastic with a view to improving the heat resistance capacity thereof.

This bobbin 51 comprises a cylindrical body 52 and two flanges formed at the ends thereof in such a manner as to be approximately perpendicular to the rotational axis of the body 52 (a first flange 53 and a second flange 54). In this embodiment, the length of the body 52 (the distance between the first and second flanges 53 and 54) is 5.5 times greater than the diameter of the circular-sectioned wire wound on the bobbin 51.

Figure 31:
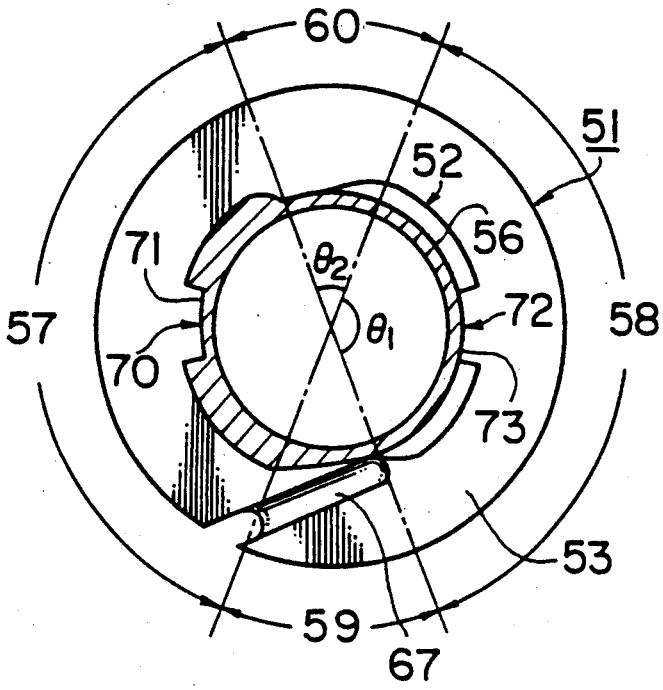
FIG. 31 is a sectional view of a bobbin for a coil assembly constituting an embodiment of this invention.
Figure 33:
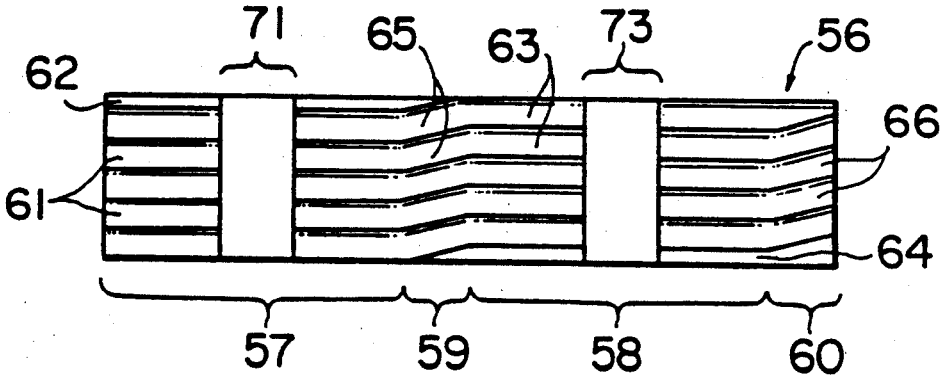
FIG. 33 is a development of the coil winding surface of the bobbin shown in FIGS. 31 and 32.

The peripheral surface of the body 52 constitutes a winding surface on which the first-stage coil winding is performed. FIG. 33 is a development of the surface. As shown in FIG. 31, this winding surface, i.e., the peripheral section of the body 52, is composed of two parallel-groove sections (a first and a second parallel-groove section 57 and 58) situated at opposed positions on the body 52 and two opposed shift areas (a first and a second shift area 59 and 60).

The first parallel-groove section 57 serves to guide the coil wire parallel to the first and second flanges 53 and 54. For example, five first parallel grooves 61 are formed in the first parallel-groove section 57, from the side of the first flange 53. The width of this first parallel groove 61 is approximately the same as the diameter of the coil wire (round wire), and the depth thereof is about ⅓ to ½ of the diameter of the coil wire. The section between the second flange 54 and the first parallel groove 61 on the side of the second flange. 54 is formed as a first projection 62 having a width corresponding to half the outer coil wire diameter, the height of this first projection 62 being about ⅓ to ½ of the coil wire diameter.

The second parallel-groove section 58 serves, like the first parallel-groove section 57, to guide the coil wire parallel to the first and second flanges 53 and 54, and includes five second parallel grooves 63. The width of this second parallel groove 63 is approximately the same as the coil wire diameter, and the depth thereof is about ⅓ to ½ of the coil wire diameter. The section between the first flange 53 and the second parallel groove 63 on the side of the first flange 53 is formed as a second projection 64 having a width corresponding to half the outer coil wire diameter, the height of the second projection 64 being about ⅓ to ½ of the coil wire diameter.

Figure 32:
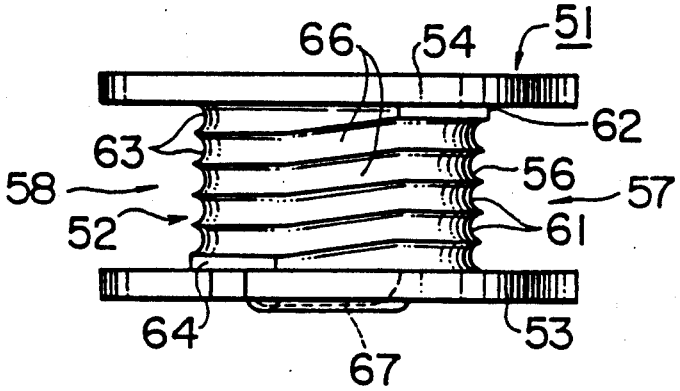
FIG. 32 is a front elevational view of the bobbin shown in FIG. 31.

That is to say, the first parallel grooves 61 of the first parallel-groove section 57 and the second parallel grooves 63 of the second parallel-groove section 58 are off-set from each other in the axial direction by about half the groove width, as shown in FIGS. 32 and 33.

The first shift area 59 serves to modify the deviation between the first and second parallel grooves 61 and 63, and is equipped with five first shift grooves 65 for guiding the coil wire from the first parallel grooves 61 to the second parallel groove 63.

The second shift area 60 serves, like the first shift area 59, to modify the deviation between the first and second parallel grooves 61 and 63, and includes four second shift grooves 66. That section of the second shift area 60 which is on the side of the first flange 53 is formed as a coil wire introducing section, which serves, as shown in FIG. 31, to guide the coil wire to the first parallel groove 61 on the side of the first flange 53, the coil wire being guided through a winding-start guide groove 67 formed in the first flange 63 onto the winding surface 56.

In this embodiment, the separation surfaces 68 and 69 of the mold (see FIG. 34) for forming the bobbin 51 are positioned in the intermediate areas of the first and second parallel-groove sections, respectively.

As shown in FIG. 31, above the area in which the mold separation surface 68 is positioned (a first juncture 70) is formed as a first flat section 71 having a predetermined width, with the first juncture 70 at its center. That is, no first parallel groove 61 is formed in this first flat section 71, which is at the same level as the bottom of the first parallel grooves 61.

As shown in FIG. 31, above the area in which the mold separation surface 69 is positioned (second juncture 72) is formed as a second flat section 73 having a predetermined width, with the second juncture 72 at its center. That is, no second parallel groove 63 is formed in this second flat section 73, which is at the same level as the bottom of the second parallel grooves 63.

The configuration of the bobbin 51 is identical with that of the above-described bobbin 41 except for some parts, permitting orderly winding to be positively performed even if a coil wire is rapidly wound on the bobbin 51. Further, the first and second shift areas 59 and 60 are formed at opposed positions on the bobbin 51. At the same time, the distance between the first and second flanges 53 and 54 is set at an odd number times the coil wire diameter plus ½ thereof (5.5 times in this embodiment), so that the positions at which the coil wire is shifted from one stage to another are situated at symmetrically arranged positions (as in the case of FIG. 26). The coil assembly obtained by winding the coil wire on the bobbin is rotationally well balanced, needing no balance modification after coil winding.

The first-stage coil wire winding condition in the first and second flat sections 71 and 73 formed between the first and second parallel-groove sections 57 and 58 will now be described.

The first flat section 71 is formed in the intermediary section of the first parallel grooves 61. Accordingly, any two first parallel grooves 61 situated before and after the first flat section 71 are on the same straight line. As a result, the coil wire, guided from a first parallel groove 61 to the first flat section 71, is guided to the first parallel groove 61 which is aligned with that first parallel groove 61 through which it passed before being guided to the first flat section 71.

The second flat section 73 is formed, like the first flat section 71, in the intermediary section of the second parallel grooves 63. Accordingly, any two second parallel grooves 63 arranged before and after the second flat section 73 are on the same straight line. As a result, the coil wire, guided from a second parallel groove 63 on the second flat section 73, is guided to the second parallel groove 63 which is aligned with that second parallel groove 63 through which it passed before being guided to the second flat section 73.

That is, since the first and second flat sections 71 and 73 are formed in the respective intermediary sections of the first and second parallel-groove sections 57 and 58, the coil winding condition on the bobbin 51 is not disturbed.

Thus, orderly winding can be attained in the second winding stage and thereafter as well as in the first winding stage, even if the first and second flat sections 71 and 73 are formed on the peripheral surface of the body 52 constituting the winding surface 56.

Next, the mold for forming the bobbin 51 will be described.

Figure 34:
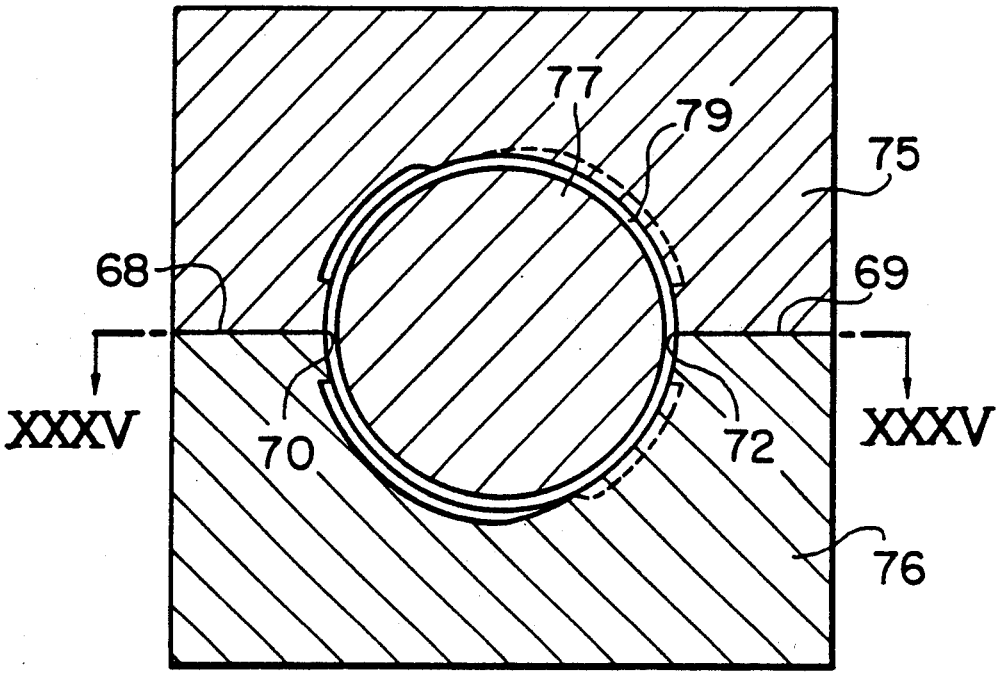
FIG. 34 is a longitudinal sectional view of a mold used for obtaining the plastic bobbin shown in FIGS. 31 to 33.
Figure 35:
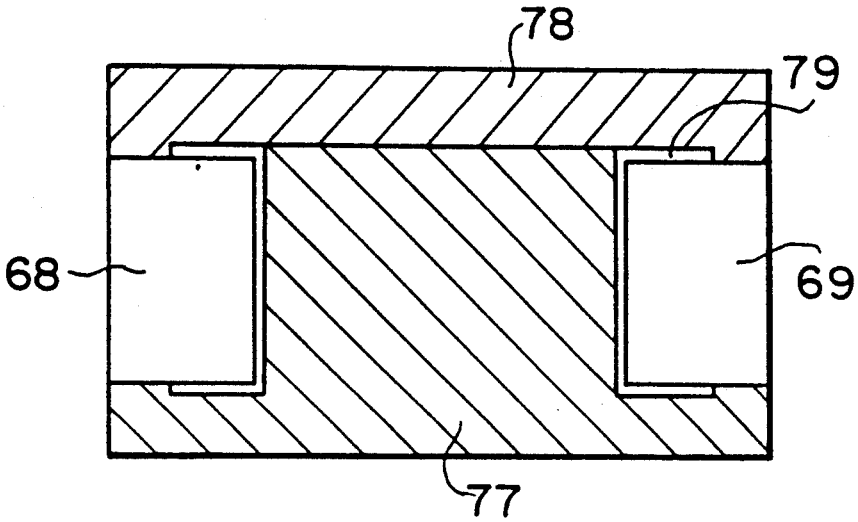
FIG. 35 is a sectional view taken along the line XXXV—XXXV of FIG. 34.

The bobbin 51, which is formed from a plastic, is manufactured using the mold shown in FIGS. 34 and 35. The mold is made of a hard material such as iron or stainless steel, and is divided, in this embodiment, into four sections 75, 76, 77 and 78. That is, the mold is composed of a first and a second mold section 75 and 76 for forming the outer peripheral surfaces of the body 52, a third mold section 77 for forming the inner peripheral surface of the body 52 and for forming the first flange 53 between itself and side surfaces of the first and second mold sections 75 and 76, and a fourth mold section 78 for forming the second flange 54 between itself and the other side surfaces of the first and second mold sections 75 and 76. A resin is poured into the voids defined between the first, second, third and fourth mold sections 75, 76, 77 and 78, which are taken off after the resin has cured, thus forming the bobbin 51.

Because of the structural limitation of the mold, there exist two mold separation surfaces 68 and 69 separating the first and second mold sections 75 and 76 for forming the body 52 of the bobbin 51. The bobbin 51 of this embodiment includes the first and second flat sections 71 and 73 (FIGS. 31, 33) extending over a predetermined range in the middle of which the first and second junctures 70 and 72 (FIG. 31) corresponding to the separation surfaces 68 and 69 are situated (see FIG. 31). Accordingly, those portions of the surfaces of the first and second mold sections 75 and 76 (for forming the winding surface 56) which are near the positions where the first and second sections 75 and 76 are mated with each other are formed smooth.

Figure 36:
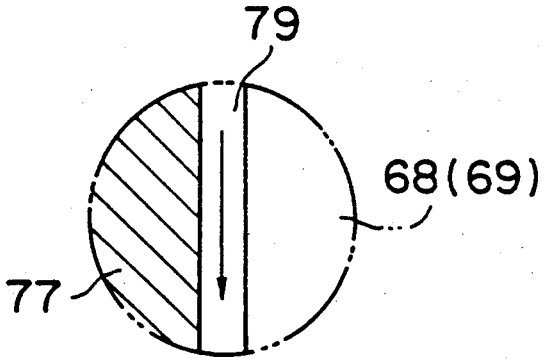
FIG. 36 is a sectional view of the essential part of the mold shown in FIGS. 34 and 35, illustrating the resin flow on the mold division surface.

FIG. 36 shows the way the resin is poured over the separation surfaces 68 and 69 between the first and second mold sections 75 and 76. As shown in the drawing, the resin flowing over the separation surfaces 68 and 69 between the first and second mold sections 75 and 76 is made to flow along flat and smooth surfaces, so that the resin flow is smooth. As a result, the separation surfaces 68 and 69 between the first and second mold sections 75 and 76 are less eroded by the resin flow. It is to be noted that, when mold grooves for forming the bobbin grooves are provided at the positions of the separation surfaces, the resin flowing over this section in the direction perpendicular thereto will erode the projections at the positions of the separation surfaces. As a result, the generation of the local projections at the first and second junctures 70 and 72 will be restrained, which projections would be generated there due to the erosion of the separation surfaces 68 and 69 between the first and second sections 75 and 76, even if the first and second sections 75 and 76 are used for a long period of time.

That is, the arrangement in accordance of this embodiment helps to avoid the generation of the projections on the outer peripheral surface of the body 52 due to the erosion of the mold separation surfaces 68 and 69 by the resin, so that any outer peripheral irregularities in a coil can be avoided. Further, it helps to avoid jumping of the coil wire 55 during winding operation, thereby permitting the orderly winding to be positively performed in each winding stage.

In the embodiment shown in FIGS. 31 to 36 the distance between the first and second flanges 53 and 54 are set at an even number of times and half the wire diameter, and the first and second projections 62 and 64 are arranged in 180° symmetry, the coil wire being wound on the bobbin 51 in the manner shown in FIG. 25. However, this invention should not be construed as limited to the above. For example, the above-mentioned distance can be set at an odd number of times, an even number of times, or an even number of times and half the diameter of the wire. When the distance between the first and second flanges 53 and 54 is set at an even number of times the diameter of the coil 55, the manner of winding is the same as that shown in FIG. 26.

While in the above-described embodiment the sections in which the mold separation surfaces 68 and 69 (first and second junctures 70 and 72) are positioned are situated in the first and second parallel-groove sections 57 and 58, it is also possible to position the first and second junctures 70 and 72 in the first and second shift areas 59 and 60, eliminating part of the first and second shift areas 59 and 60 or the entire first and second shift grooves 65 and 66.

Further, while in the above-described embodiment the bobbin 51 is equipped with two shift areas arranged at opposed positions it goes without saying that this invention can be applied to a bobbin having a single shift area. Thus, this invention can be applied to any type of bobbin 51 having grooves for guiding a coil wire on the peripheral surface of the body 52 thereof.

What is claimed is:

1. A coil assembly of the type which is equipped with a bobbin having a body on the outer peripheral coil winding surface of which a wire of polygonal cross-section is wound, and a first and a second flange which are provided at either end of this body and which are approximately perpendicular to the rotational axis of the body, comprising on the coil winding surface of said bobbin:

a plurality of first mutually parallel grooves, each of which has a section of V-notch shape which corresponds to an angular portion of said wire, which are parallel to said flanges and which are so arranged that the centers of adjacent grooves are separated from one another by a distance P which is the width of said grooves and which is substantially the same as the diagonal diameter of said wire; and a plurality of second mutually parallel grooves corresponding to said first parallel grooves, each of which has a section of V-notch shape which corresponds to an angular portion of said wire, the ends of which do not meet with the ends of said first grooves and which are parallel to said flanges and are so arranged that the centers of adjacent grooves are also separated from one another by the distance P;

each of the first grooves being off-set from the corresponding second groove in the axial direction by the distance of about P/2.

2. A coil assembly as claimed in claim 1 further comprising a plurality of first mutually parallel oblique grooves and a plurality of second mutually parallel oblique grooves respectively formed in a pair of intermediate sections provided between the respective ends of said first and second grooves, said intermediate sections having predetermined lengths in the circumferential direction, said first and second mutually parallel oblique grooves respectively connecting each of the first grooves to the corresponding second grooves.

3. A coil assembly as claimed in claim 2, wherein said pair of intermediate sections provided between the respective ends of said first and second grooves and having predetermined lengths in the circumferential direction are formed at positions approximately opposed to each other with the rotational axis of the body between them.

4. A coil assembly as claimed in claim 2, wherein a first projection whose width in the axial direction is about P/2 is formed between said first flange and that first groove which is adjacent to said flange, and wherein a second projection whose width in the axial direction is about P/2 is formed between said second flange and that second groove which is adjacent to said second flange.

5. A coil assembly as claimed in claim 4, wherein said pair of intermediate sections provided between the respective ends of said first and second grooves and having predetermined lengths in the circumferential direction are formed at positions approximately opposed to each other with the rotational axis of the body between them.

6. A coil assembly as claimed in claim 1, wherein the cross-sectional configuration of said first and second grooves are so determined through selection of the width and depth of the groove that the two tangents which respectively pass the points on the inner groove surfaces at which they are in contact with the wire and which are in an phantom plane intersecting the axis of the body intersect each other with an intersection angle $\beta$ in the range 90° to 120°.

* * * * *